United States Patent [19]

Honjo et al.

[11] 3,955,976

[45] May 11, 1976

[54] DEVELOPING METHOD IN ELECTROPHOTOGRAPHY

[75] Inventors: Satoru Honjo; Seiji Matsumoto; Masamichi Sato, all of Osaka, Japan

[73] Assignee: Xerox Corporation, Stamford, Conn.

[22] Filed: Dec. 4, 1970

[21] Appl. No.: 95,139

[52] U.S. Cl. ..... 96/1 CY; 96/1 R; 96/1.5; 427/15; 427/14

[51] Int. Cl.[2] ..... G03G 13/10; G03G 13/22

[58] Field of Search ..... 96/1 R, 1 A, 1 E, 1 C, 96/1 LY, 1 SD, 1.5; 117/37 LE, 17.5

[56] References Cited

UNITED STATES PATENTS 3,108,893 10/1963 Oliphant ..... 96/1 C 3,118,789 1/1964 Wiswell et al. ..... 96/1.5 X

FOREIGN PATENTS OR APPLICATIONS

43/21785 9/1968 Japan ..... 96/1.5

*Primary Examiner*—Rolland E. Martin, Jr.
*Attorney, Agent, or Firm*—James J. Ralabate; James P. O'Sullivan; John H. Faho

[57] ABSTRACT

A method for developing continuous tone images is disclosed involving the use of a development electrode and a backing electrode. The backing electrode is made of a conductive material and has projections on its surface which are fabricated to penetrate the substrate of a photoconductive imaging member. In this manner, sufficient electrical contact is made between the development electrode and the substrate to insure proper development.

5 Claims, 3 Drawing Figures

INVENTOR.
SATORU HONJO
MASAMICHI SATO
BY SEIJI MATSUMOTO
Anthony W Karambelas
ATTORNEY

DEVELOPING METHOD IN ELECTROPHOTOGRAPHY

BACKGROUND OF THE INVENTION

This invention relates in general to a developing method useful in electrophotography and, more specifically, to a developing method suitable for reproducing reliably continuous tone images in a short developing period.

In electrophotography an electrostatic image is formed on a photoconductive insulating surface overlying an electrically conductive substrate generally by charging the surface and then selectively dissipating the charge by exposure to a pattern of actinic radiation. Whether the latent electrostatic image is formed by this method or another, the resulting charge pattern is conveniently utilized by the deposition of an electroscopic marking material commonly called a "toner" through electrostatic attraction whereby there is formed a visible image corresponding to the electrostatic latent image.

In the developing process toner is electrostatically attracted and deposited on the latent electrostatic image if its charge polarity is opposite to the polarity of the image, or it is repelled if the polarity of the toner is the same as that of the latent electrostatic image, and deposits on the non-charge areas. Where it is desired to reproduce an image having a high contrast or a line image, the cascade development method is usually employed. If it is desired to reproduce a continuous tone image, electrode development is usually employed in which the conductive electrode is positioned closely against the surface bearing the latent image. The development electrode serves to attenuate the electric field strength above the surface bearing the latent image and by causing the electrical lines of force to straighten above the electrostatic latent image, a uniform field results which allows for higher efficiency and development and good image reproduction without edge effects. In the development method using Coulomb's force of attraction, commonly referred to as attraction development, the potential of the development electrode is preferably kept at the same potential of the conductive substrate of the photoconductive insulating layer for as long a period as possible during the development process. This requirement is very important in order to obtain high quality reproduction. It is found that when the potential difference between the development electrode and the conductive substrate is noticeable, the reproduction of an original image having areas of low image density is poorly reproduced and smoothness of tone suffers such that tone as is obtainable in the silver halide photography process is not approached. One explanation which may be offered in understanding the above phenomenon is that during the development process when toner particles, for example, having positive charges move towards a latent image having negative charges and deposit thereon, the positive charges located at the interface between the photoconductive insulating layer and the substrate migrate to the ground in order to neutralize completely the surface charges of the latent image on the insulating layer. When the electric resistivity between the substrate and the backing electrode or the ground is negligibly small, the charges at the interface discharge instantaneously and the voltage which occurs across the resistive member is also negligibly small, consequently, the development process may be performed without any problem. However, if the resistivity of the substrate is higher than that of the electrode, for example, than that of a metal where, for example, the substrate is a sheet of conductively treated paper, there exists a considerably high floating or stray resistance between the interface and the ground so that an unfavorable voltage is present. In the case of a paper substrate comprising fibers, the voltage is developed because of point to point contact between the substrate and the backing electrode. This voltage is seen to become higher when liquid development is employed in order to accomplish development in a shorter period of time. This bias voltage that develops on the substrate interferes with the deposition of toner particles on the surface bearing the latent electrostatic image. If a bias voltage is developed at about 5 volts, the image areas having a charge less than 5 volts may not be developed initially. Continuing the development process for long periods of time allows deposition of toner particles onto the image areas having low voltage if the life of the latent electrostatic image is long enough to allow development. In actual practice, however, it is found that the latent electrostatic image decays rapidly during the development process so that low surface voltage areas remain undeveloped resulting in poor reproduction of continuous tone images. It, therefore, becomes necessary to maintain the floating resistance between the substrate and the backing electrode as low as possible. Decreasing this floating resistance may be achieved by, for example, by decreasing the resistivity of the substrate itself and/or decreasing the contact resistivity between the substrate and the backing electrode. Therefore, when it is desired to obtain high quality reproduction of continuous tone images in high speed electrophotography, especially when employing liquid development, it is exttremely important to keep good electrical contact between the interface of the photoconductive insulating layer and the substrate and the development electrode. One method to improve such electrical contact is to contact one part of the substrate with the ground conductor when the substrate is a highly conductive member such as a metal. In the situation where the substrate is a flexible one such as a sheet of paper, a special structure is needed to provide good electrical contact. A sheet of paper with a metal foil backing is ideal from the electrical point of view, but its mechanical properties are so different from those of the paper that it has many undesirable points. Carbon impregnated sheets possess low electrical resistivity, however, they are black in appearance so that it is necessary to employ a thicker photoconductive insulating layer or a white undercoating between the photoconductive layer and the substrate. In such a structure it is found that the resistivity of the carbon impregnated paper is higher in several orders of magnitudes than that of the metal sheet so that it is preferable to contact all or most of the back area of the substrate with the backing electrode in order to ground the photosensitive paper sheet. Insufficient contact between the backing electrode and the substrate increases the electric current density resulting in an increased bias voltage which undesirably effects the development process. Maintaining proper electrical contact in order to avoid development of undesirable bias is found to be unexpectedly difficult in such members. It is found in addition where light scattering layers are employed the resistivity of these layers are usually in the order of 100 to 1000 times higher than the carbon impregnated layers so that even if the light scattering layer which is employed is as thin as 1/100 of the substrate thickness impracticable resistivities are still realized.

SUMMARY OF THE INVENTION

It is, therefore, an object of this invention to provide a novel developing method devoid of the above noted deficiencies.

Another object of this invention is to provide a novel method of development in electrophotography which is suitable for the reproduction of continuous tone images.

Still another object of this invention is to provide a developing system which eliminates the development of undesirable bias potential at the interface of the photoconductive insulating layer and its substrate.

Still another object of this invention is to provide a novel method of development in electrophotography particularly suitable for the development of continuous tone images which is inexpensive and simple to employ.

The above objects and others are accomplished in accordance with the system of the present invention, generally speaking, by applying a backing electrode to the substrate of an electrophotographic member which has electrically conductive projections suitably adapted to penetrate the substrate of the electrophotographic member in order to provide satisfactory electrical contact therebetween.

A conventional electrophotographic member may comprise a photosensitive paper sheet having an electrically conductive substrate and a photoconductive insulating layer superimposed thereover. When conventional electrophotographic development techniques are employed in developing a latent electrostatic image deposited thereon, a development electrode is placed over the photosensitive paper bearing an electrostatic image and an electrically conductive backing electrode is placed immediately thereunder. The backing electrode and the development electrode may be electrically connected to each other so as to be grounded, but this is not necessary. In the ideal situation the electrically conductive substrate is perfectly connected electrically to the backing electrode, but in actuality the conductive substrate, for example, a paper sheet comprising fibers is so rough that only point to point contact is made in many areas between the substrate and the electrode and, consequently, there is noticeable resistivity between the conductive substrate and the backing electrode. Consequently, it is preferable to have a highly conductive substrate in order to obtain good continuous tone reproductions, for example, a substrate may be employed which comprises a black paper sheet impregnated with fine carbon particles. A paper sheet made partially of metallized glass fibers may also be employed to obtain the desired conductivity. In general, desirable characteristics of such a substrate are sufficiently low resistivity in the area contacting the photoconductive insulating layer, and a laterally continuous layer that possesses longitudinal electrical resistivity less that about $10^7$ ohms per cm and preferably less than $10^5$ ohms per cm. Acceptable levels of longitudinal electrical resistivity are dependent upon the period of time required for development, a considerably higher resistivity being acceptable for a long development period of time so that if a bias voltage generated by the electric current through the longitudinal resistance of the substrate during development is less than a certain value, a continuous tone reproduction of good quality may be obtained. Allowable bias voltage should be less than about 15 volts and desirably less than 3 volts. As mentioned above, if the substrate is metallic, only one point of contact is sufficient for satisfactory grounding. However, in the case of a paper sheet, since its lateral resistivity is a significant factor, perfect electrical contact of the entire area of the substrate or many points of contact distributed uniformly over the entire area of the substrate is required. In accordance with this invention many projections having pointed ends of small radius distributed uniformly on the backing electrode and having sufficient mechanical strength to be thrust into the substrate should be employed to provide such contact.

The invention having been set forth in general terms, details of the present invention and variations thereof will be discussed in terms of the drawings hereinafter presented of which:

Figure 1:
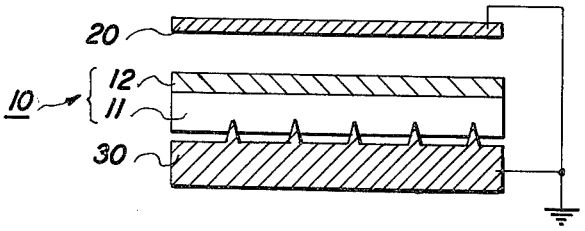
FIG. 1 illustrates a schematic cross section of one embodiment of the system of the present invention.

In FIG. 1 is seen one embodiment of the present invention employing a relatively thick paper sheet 10 having a thickness of between 150 and 200 microns comprising a photoconductive layer 12 overlying a paper substrate 11. Projections from a conductive backing or backing electrode 30 having a depth of about 50 microns are shown thrusting into the paper sheet to provide proper electrical contact between the backing electrode substrate connection and the developing electrode 20.

Figure 2:
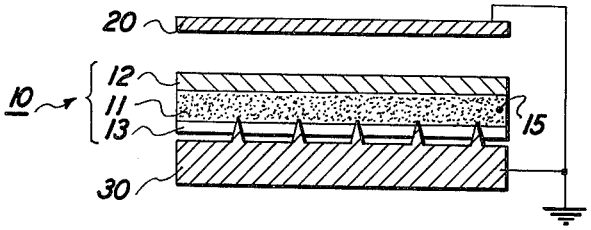
FIG. 2 illustrates another cross section of one embodiment of the system of the present invention wherein a light scattering layer is employed.
Figure 3:
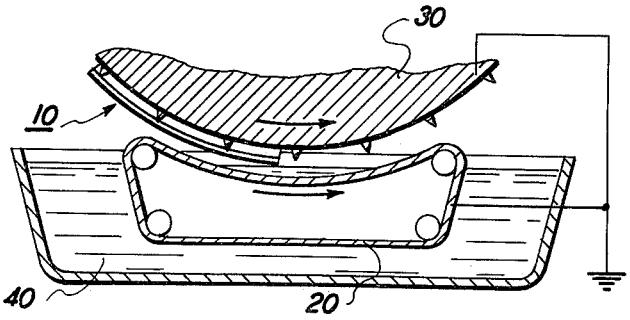
FIG. 3 illustrates a sectional view of a developing apparatus employing the development system of the present invention.

In FIG. 2 there is seen a photosensitive paper 10 consisting of three layers, an electrically low resistive layer 11 impregnated with carbon, a photoconductive layer 12 overlying the carbon impregnated layer and a light scattering layer 13 coated on the underside of conductive layer 11. It is found if layer 11 is grounded only at the point indicated by arrow 15, the relatively large lateral resistance in layer 11 causes bias voltages to be generated from point to point in member 10 during the development process despite the fact that no bias voltage may be generated at the grounded point. Because of this, reproduction of continuous tone images becomes impractical. As seen in FIG. 3 when the substrate is grounded at many points by thrusting the projections from the conductive backing or backing electrode 30, reliable reproduction of continuous tone images is obtained particularly superior in low image density over the entire image area.

The light scattering layer 13 is usually about several microns thick and comprises white pigments dispersed in an electrically insulating and water-impervious binding agent, such as, hardened gelatine, casein, styrene-butadiene copolymers, or methacrylicbutadiene copolymers. The resistivity of this layer is found to be approximately about $10^7$ ohms per cm which is undesirable for the reproduction of continuous tone images.

Although any suitable arrangement and concentration of such projections may be employed in accordance with the system of the present invention, a concentration of about 0.25 to 25 projections per $cm^2$ is usually employed.

Any suitable size projection may be employed in accordance with the system of the present invention. Projections having a diameter of from about 10 to about 100 microns at the pointed end and from about 20 to about 400 microns diameter at the base are frequently employed. These projections may be made or fabricated of any suitable material. Typical materials include stainless steel, tungsten, molybdenum and other metals. The materials employed must be chemically stable, of low electrical resistivity and mechanically strong. In addition to pure metals either plated or metallized projections are also suitable for use.

The projections may penetrate the substrate to any suitable depth. However, it is preferable that the end of the projections reach just the interface between the photoconductive insulating layer and the substrate and not into the photoconductive insulating layer. The position of the end of these projections must be controlled in the photosensitive member so that the bias voltage generated to the photoconductive insulating layer in early stages of development does not increase over the desired voltage.

Any suitable method of development may be employed in the system of the present invention. Typical methods employing powder development include cascade, touchdown, and magnetic brush. Since the capability of proper tone reproduction in the low image density areas depends strongly upon the size of the toner particles employed, the finer particles giving the higher fidelity in tone reproduction, liquid development is preferred over powder development to eliminate any such dependence.

Although the present examples were specific in terms of conditions and materials used, any of the above listed typical materials may be substituted when suitable in the above examples with similar results. In addition to the steps used to carry out the process of the present invention, other steps or modifications may be used if desirable. For example, a bias voltage may be employed between the development electrode and the backing electrode to provide further control of electrical development parameters. In addition, other materials may be incorporated in the system of the present invention which will enhance, synergize or otherwise desirably affect the properties of the systems for their present use.

Anyone skilled in the art will have other modifications occur to him based on the teachings of the present invention. These modification are intended to be encompassed within the scope of this invention.

What is claimed is:

1. A method of development suitable for the reproduction of continuous tone images comprising providing an imaging member comprising a conductive substrate having a photoconductive layer superimposed thereover on which is formed a latent electrostatic image having charged image areas of varying charge density, placing a development electrode over said imaging member, providing a backing electrode comprising a conductive material having projections located on the surface thereof, applying said backing electrode to the underside of said imaging member causing said projections to penetrate said substrate so that sufficient electrical contact is made to prevent the development of bias voltages in the substrate thereby allowing for the proper reproduction of continuous tone images.

2. The method as defined in claim 1 wherein said projections are situated on said backing electrode at a concentration of from about 0.25 to about 25 projections per $cm^2$.

3. The method as defined in claim 2 wherein said projections have a diameter from about 10 to 100 microns at their pointed end and a diameter of from 20 to 400 microns at their base.

4. A method of reproducing continuous tone images comprising providing an electrophotographic imaging member, said imaging member comprising a photoconductive material disposed on the surface of a conductive substrate, forming an electrostatic image on said imaging member, placing a developing electrode over said imaging member, providing a backing electrode having projections located on the surface thereof, causing said projections to penetrate the substrate of said imaging member and developing said image.

5. The method as defined in claim 4 wherein said development step comprises liquid development.

* * * * *